US010242532B2

(12) United States Patent
Russell et al.

(10) Patent No.: US 10,242,532 B2
(45) Date of Patent: Mar. 26, 2019

(54) BLACKJACK GAMING SYSTEM

(71) Applicant: DOUBLE-BACK JACK, LLC, Warrendale, PA (US)

(72) Inventors: Steven L. Russell, Jeannette, PA (US); James L. Cook, III, Wexford, PA (US)

(73) Assignee: Double-Back Jack, LLC, Warrendale, PA (US)

( * ) Notice: Subject to any disclaimer, the term of this patent is extended or adjusted under 35 U.S.C. 154(b) by 64 days.

(21) Appl. No.: 15/345,151

(22) Filed: Nov. 7, 2016

(65) Prior Publication Data

US 2017/0109971 A1 Apr. 20, 2017

Related U.S. Application Data

(63) Continuation-in-part of application No. 12/608,097, filed on Oct. 29, 2009, now abandoned.

(60) Provisional application No. 61/197,726, filed on Oct. 30, 2008.

(51) Int. Cl.

| | |
|---|---|
| ***A63F 1/00*** | (2006.01) |
| ***G07F 17/32*** | (2006.01) |
| ***A63F 1/10*** | (2006.01) |

(52) U.S. Cl.

CPC ..... *G07F 17/3258* (2013.01); *A63F 1/00* (2013.01); *A63F 1/10* (2013.01); *G07F 17/3209* (2013.01); *G07F 17/3216* (2013.01); *G07F 17/3218* (2013.01); *G07F 17/3246* (2013.01); *G07F 17/3248* (2013.01); *G07F 17/3288* (2013.01); *G07F 17/3293* (2013.01); *A63F 2001/003* (2013.01)

(58) Field of Classification Search

CPC ..... A63F 1/00

USPC ..... 273/292

See application file for complete search history.

(56) References Cited

U.S. PATENT DOCUMENTS

| | | | | |
|---|---|---|---|---|
| 5,364,105 | A | 11/1994 | Jones | |
| 5,407,209 | A | 4/1995 | Prerost | |
| 5,549,300 | A | 8/1996 | Sardarian | |
| 5,791,989 | A * | 8/1998 | Slinkman | 463/12 |

(Continued)

FOREIGN PATENT DOCUMENTS

| | | |
|---|---|---|
| WO | 2011/014318 | 2/2011 |

OTHER PUBLICATIONS

U.S. Appl. No. 12/608,097, filed Oct. 29, 2009, Method of Playing a Variation of Blackjack (21).

(Continued)

*Primary Examiner* — Dolores Collins

(74) *Attorney, Agent, or Firm* — Fox Rothschild LLP

(57) ABSTRACT

A system for playing blackjack requires a player or electronic system to: (i) receive a first bet from a player; (ii) deal an initial two-card hand to the player; (iii) deal one or more additional cards to the player; (iv) determine whether a sum total value of the initial two-card hand and the one or more additional cards exceeds twenty-one; (v) if so, offer the player an opportunity to place an additional bet; (vi) receive, from the player, the additional bet; (vii) in response receiving the additional bet, deal a final card to the player (optionally from a shoe that is different from that used for the initial hand); (vii) subtract a value of the final card from the sum total value to yield a new value; and (ix) based on the new value, determine whether the player has a winning hand, a push, or a losing hand.

8 Claims, 4 Drawing Sheets

(56) References Cited

U.S. PATENT DOCUMENTS

| | | | | |
|---|---|---|---|---|
| 5,806,846 | A * | 9/1998 | Lofink et al. | 273/292 |
| 6,027,118 | A | 2/2000 | Aramapakul et al. | |
| 6,113,102 | A * | 9/2000 | Marks et al. | 273/292 |
| 6,158,741 | A | 12/2000 | Koelling | |
| 6,217,024 | B1 * | 4/2001 | Lofink et al. | 273/292 |
| 6,409,174 | B1 * | 6/2002 | Demarest | 273/292 |
| 6,422,565 | B1 * | 7/2002 | Daines | 273/292 |
| 6,450,500 | B1 * | 9/2002 | Miller | 273/292 |
| 6,511,071 | B1 * | 1/2003 | Artle et al. | 273/292 |
| 6,540,230 | B1 * | 4/2003 | Walker et al. | 273/292 |
| 6,604,741 | B1 * | 8/2003 | Snow | |
| 6,679,497 | B2 * | 1/2004 | Walker et al. | 273/292 |
| 6,776,416 | B1 | 8/2004 | Jackson | |
| 6,808,173 | B2 * | 10/2004 | Snow | 273/292 |
| 7,022,015 | B2 | 4/2006 | Mostashari | |
| 7,144,011 | B2 * | 12/2006 | Asher et al. | 273/292 |
| 7,222,854 | B2 * | 5/2007 | Sorge | 273/292 |
| 7,222,855 | B2 | 5/2007 | Sorge | |
| 7,255,351 | B2 * | 8/2007 | Yoseloff et al. | 273/274 |
| 7,329,178 | B1 | 2/2008 | Moore et al. | |
| 7,549,642 | B2 * | 6/2009 | Centrone | 273/292 |
| 7,568,704 | B1 * | 8/2009 | Davis et al. | 273/292 |
| 7,648,140 | B2 * | 1/2010 | Silverman | 273/292 |
| 2003/0139211 | A1 | 7/2003 | Mostashari | |
| 2004/0053655 | A1 | 3/2004 | Hyams et al. | |
| 2007/0069469 | A1 | 3/2007 | Silverman | |
| 2007/0138744 | A1 | 6/2007 | Hall | |
| 2009/0118001 | A1 * | 5/2009 | Kelly et al. | 463/29 |
| 2010/0178972 | A1 * | 7/2010 | Cipiti | 463/12 |

OTHER PUBLICATIONS

Printout of Google Internet search for "standard blackjack game with additional bet after busting" dated Sep. 25, 2011.

* cited by examiner

BLACKJACK GAMING SYSTEM

RELATED APPLICATIONS AND CLAIM OF PRIORITY

This patent application is a continuation-in-part of U.S. patent application Ser. No. 12/608,097, the disclosure of which is fully incorporated into this document by reference.

BACKGROUND

Casinos and other gaming service providers rely on new technologies to attract and retain players. Systems that can spark long-term player interest with additional features such as additional opportunities to win and innovative technical user interface features, can enhance the gaming service provider's ability to keep the player playing for multiple rounds.

This document describes a system that is directed to improving player retention as compared to existing blackjack gaming systems.

SUMMARY

In an embodiment, an electronic gaming system includes a processor, a display device, and a non-transitory memory portion containing a plurality of shoes. Each shoe represents one or more decks of playing cards shuffled according to randomization algorithm. The system also includes a non-transitory memory portion containing programming instructions that are configured to cause the system to: (i) receive a first bet from a player via a user interface; (ii) deal an initial two-card hand to the player from a first one of the shoes; (iii) deal one or more additional cards to the player from the first shoe; (iv) determine whether a sum total value of the initial two-card hand and the one or more additional cards exceeds twenty-one; (v) if so, offer the player to place an additional bet; (vi) receive, from the player, the additional bet; (vii) in response receiving the additional bet, deal a final card to the player (optionally from a second one of the shoes); (viii) subtract a value of the final card from the sum total value to yield a new value; and (ix) based on the new value, determine whether the player has a winning hand, a push, or a losing hand.

DETAILED DESCRIPTION

Figure 1:
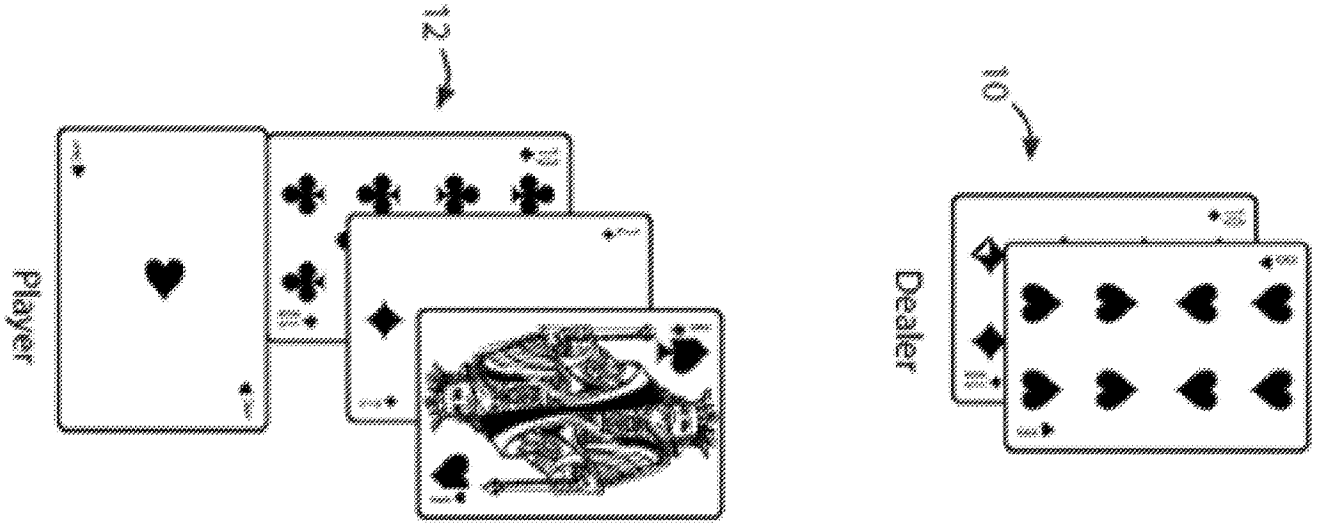
FIG. 1 illustrates a hand that may be dealt by a blackjack gaming system

Terminology that is relevant to this disclosure includes:

An "electronic device" or a "computing device" refers to a device that includes a processor and memory. Each device may have its own processor and/or memory, or the processor and/or memory may be shared with other devices as in a virtual machine or container arrangement. The memory will contain or receive programming instructions that, when executed by the processor, cause the electronic device to perform one or more operations according to the programming instructions. Examples of electronic devices include personal computers, servers, mainframes, virtual machines, containers, gaming systems, televisions, and mobile electronic devices such as smartphones, personal digital assistants, cameras, tablet computers, laptop computers, media players and the like. In a client-server arrangement, the client device and the server are electronic devices, in which the server contains instructions and/or data that the client device accesses via one or more communications links in one or more communications networks. In a virtual machine arrangement, a server may be an electronic device, and each virtual machine or container may also be considered to be an electronic device. In the discussion below, a client device, server device, virtual machine or container may be referred to simply as a "device" for brevity.

In this document, the terms "processor" and "processing device" refer to a hardware component of an electronic device that is configured to execute programming instructions. Except where specifically stated otherwise, the singular term "processor" or "processing device" is intended to include both single-processing device embodiments and embodiments in which multiple processing devices together or collectively perform a process.

In this document, the terms "memory," "memory device," "data store," "data storage facility" and the like each refer to a non-transitory device on which computer-readable data, programming instructions or both are stored. Except where specifically stated otherwise, the terms "memory," "memory device," "data store," "data storage facility" and the like are intended to include single device embodiments, embodiments in which multiple memory devices together or collectively store a set of data or instructions, as well as individual sectors within such devices.

In this document, the singular forms "a," "an," and "the" include plural references unless the context clearly dictates otherwise.

In this document, the term "comprising" means "including, but not limited to."

This document describes a method and system for playing a variation of the card game commonly known as blackjack. Blackjack, also known as twenty-one (21), that is played with one or more standard decks of fifty-two playing cards. If multiple decks are used, the decks will be shuffled together. In a physical game with cards dealt by a dealer, the cards may be maintained in a dealing shoe, which is a gaming device that holds multiple decks of cards. Some such gaming devices may include automatic shuffling functions, but for simplicity all such devices may be referred to as a "shoe" in this patent document. In an electronic game, the cards may be maintained in a "virtual" shoe, which is an electronic data set in which each card of each deck is represented as a data point in the set, and the cards are shuffled by randomizing the data points according to any suitable randomization algorithm.

In traditional blackjack, each player places a wager and is dealt a two-card hand from the shoe. Each player (or, in electronic embodiments, the gaming machine) adds the cumulative value of the cards in the player's hand. The value of each card is: (a) for cards having a numeric rank, the value is the number represented on the card; (b) for face cards, the value is ten; and (c) for Aces, the value is either one or eleven (at the player's discretion, or eleven by default unless and until a value of eleven would result in the total value of the hand exceeding twenty-one).

The player may elect to receive additional cards from the shoe, one at a time, until either (a) the player decides to stand (i.e., stop receiving additional cards), or (b) the value of the player's hand exceeds twenty-one. If the value of the player's hand exceeds twenty-one, the player "busts" and loses the wager that the player placed for that hand. If the player stops, then the dealer (or the system) deals a dealer's hand, and the player wins if either (a) the total value of the player's hand exceeds the dealer's hand value, or (b) the dealer busts.

In some embodiments of blackjack, a player who is initially dealt two cards having the same value may elect to split the hand into two hands, each of which will include one of the two initial cards. The player then places an additional wager that is equal to the first wager, and the player plays each of the two hands as an independent hand.

In some embodiments of blackjack, a player who decides to stand may also elect to "double-down" before standing by increasing the initial wager and committing to receive exactly one more card.

In the presently disclosed embodiments, rules of a blackjack such as those disclosed above are followed, with one or more new features. One new feature is that if a player busts, the player can buy back into the game by placing an additional wager and receiving one card only (as in a double-down). However, unlike in a double-down, the value of newly dealt card value will be subtracted from (rather than added to) the player's total. For the purposes of this discussion, the newly dealt card may be referred to as a "second chance card." If the new hand value (with the second chance card) is 22 or more, the player loses both the original wager and the new one. If the new hand value is 21 or less, the player waits for the dealer to finish all other hands and regular blackjack rules apply. A win for the player wins the second bet and pushes the original bet. A loss for the player loses both bets. Optionally, bets may be paid 1:1 to winning players, and players who achieve a handle value of twenty-one may be paid immediately upon obtaining twenty-one. Also optionally, a dealer's hand value of twenty-two may push all remaining bets. Optionally, if a player gets blackjack (i.e., twenty-one) on the first two cards dealt, then the bet pays a higher amount such as 2:1 (i.e., twice the value of the original bet), but all other bets are paid 1:1.

In some embodiments, the dealer or gaming machine may draw the second chance card from a separate shoe (i.e., a shoe that is different from the shoe from which the initial hand was drawn, with separate deck(s) of cards). All other play of the game may continue from the original shoe/original deck(s) of cards.

In several embodiments, a method of playing a variation of a blackjack game includes providing one or more decks of playing cards to a dealer. (In this discussion, the dealer may be a person, or the dealer may be a virtual dealer in an electronic gaming system.) Each card in each deck playing cards has a value according to conventional rules of blackjack. A player may place a first bet of a first amount of money on at an outcome of at least a portion of the game. The dealer may deal from the deck(s) of playing cards according to conventional rules of blackjack to the player and the dealer until the player elects to stop receiving cards. If the player's hand value exceeds twenty-one, the player may receive an option to receive one additional "second chance" card if the player places an additional wager that matches a value of the player's first bet. The value of the player's hand will then be reduced by the value of the second chance card, thereby providing a possibility of the player's hand value being reduced to a number less than or equal to twenty-one. The dealer continues to deal cards to the dealer and any other players according to conventional blackjack rules (with other players also receiving options for second chance cards as described above). Each player's hand value will be compared to that of the dealer to determine whether the player wins (i.e., has a hand value higher than the dealer's hand value or the dealer's hand value exceeds twenty-one), loses (i.e., has a hand value lower than the dealer's hand value or the dealer's hand value does not exceed twenty-one), or pushes (i.e. has the same value as the dealer). The system may then distribute winnings to each wining player.

Optionally, if the additional second chance card is an ace, then such ace may receive a value of one point. However, in other embodiments, the value of the ace may be one unless the value is not sufficient to reduce the player's hand value below twenty-two, in which case the second chance card may be assigned a value of eleven.

According to a second embodiment, a method of playing an extended Blackjack game includes providing a predetermined number of decks of playing cards to a dealer. Each card in each of such decks of playing cards having at least one predetermined value according to conventional rules of Blackjack. Placing a first bet by at least one player of a first predetermined amount of money on an outcome of such game.

Optionally, the system may permit a planer to place a side bet of one dollar (or any suitable amount) on an outcome of the hand. The dealer may deal cards from a shoe to a player according to conventional rules of blackjack until the player elects to stop receiving cards.

In some embodiments, if a player's hand consists of three cards including one ace valued at eleven points and two cards each having a value of ten (which may be considered to be a value of thirty-one), then if the player places an additional bet and elects to receives a "second chance" card the player may win the "second chance" bet if the "second chance" card has a value of ten (which, when subtracted from the original total of thirty-one, results in the player's hand having an ultimate value of 21).

The above referenced variations of the game are meant to provide an opportunity for a player whose hand has busted to undo the bust and continue in the game.

In another variation, a player may place a side bet of one dollar or other amount, prior to being dealt, to try to win a jackpot. In order to win the jackpot certain conditions must be met. Specifically, such player must make the side bet and thereafter such player must be dealt certain combinations of ranks of cards in order to win the jackpot. Examples of such combinations include an ace valued at eleven points and two ten point cards for a total point value of thirty-one points. Optionally, the jackpot option may be available only to a player who receives an ace and a ten-point card as the first two cards dealt in his or her hand. The player may then place an additional bet and receive his or her final card. The final card must be valued at then points to win the jackpot; if it is not a ten-point card the player does not win the jackpot. Optionally, if the final card value does not equal ten then the player may still win an amount that is less than the jackpot.

Conventional rules of blackjack, also known as 21, may apply in every embodiment described above unless specified otherwise. Additionally, it is noted that if such dealer obtains a hand of blackjack the game is over according to the conventional rules of blackjack (with a hand of blackjack being two cards having point values the sum of which totals twenty-one). However, if the player obtains blackjack and has followed the procedure for attempting to win the jackpot as outlined above in the second embodiment, such player would receive a payout on the first two cards dealt to such player.

The systems described above can help encourage player retention in a gaming system.

Reference is now made, more particularly, to FIG. 1 which is a general perspective drawing of a hand of one embodiment of the present invention. In this example, dealer's hand 10 comprises an eight of hearts and a ten of diamonds for a total hand value of eighteen. Player's hand 12 initially comprises a ten of clubs and a two of diamonds for an initial value of twelve. Player then receives a king of spades and busts with a value of twenty-two. Player then requests a "second chance" card and receives an ace of hearts which allows the player to subtract one from his score thus changing his score to twenty-one. In this hand player won via the "second chance" option.

Figure 2:
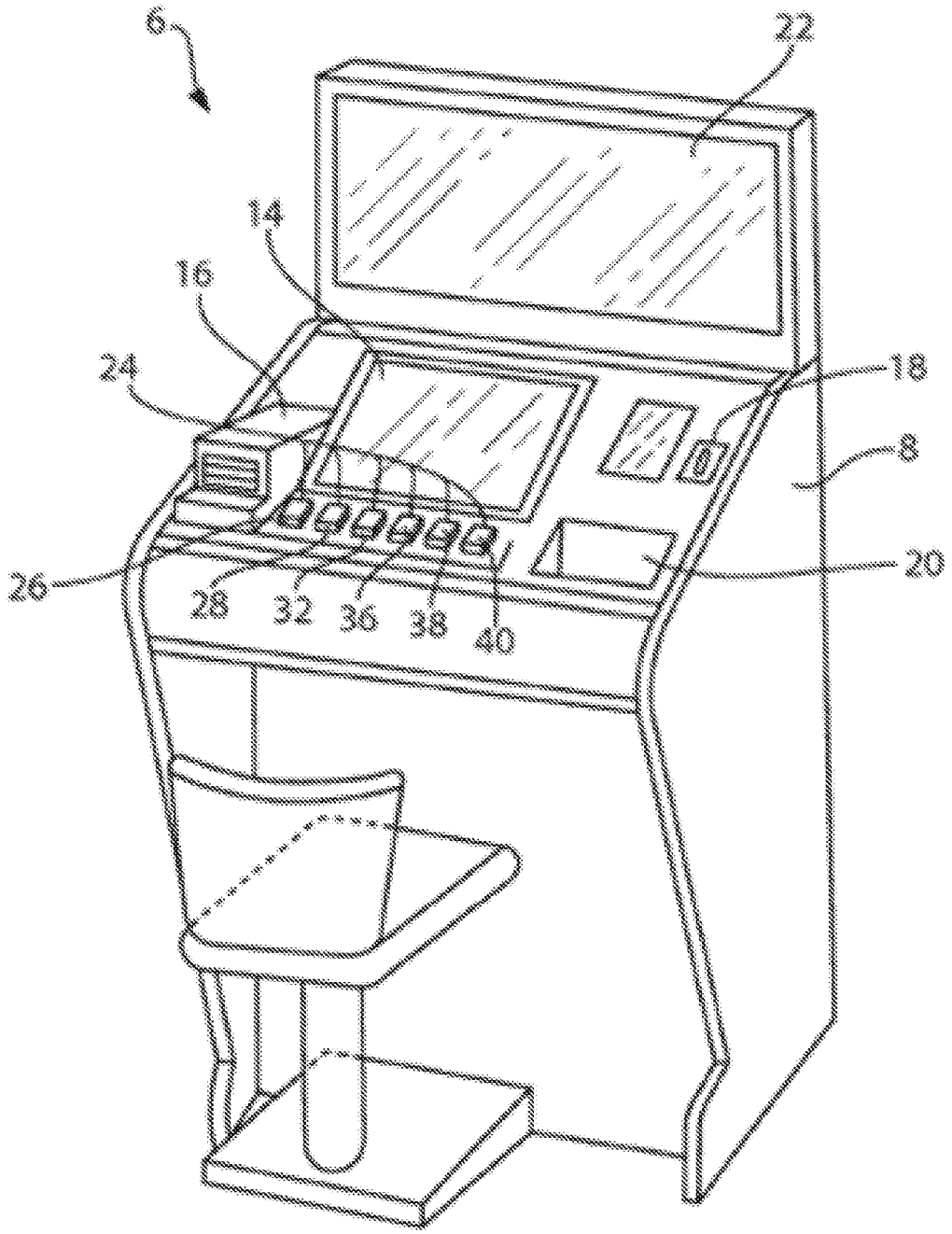
FIG. 2 illustrates an example of an electronic gaming machine that may implement a blackjack playing system.
Figure 3:
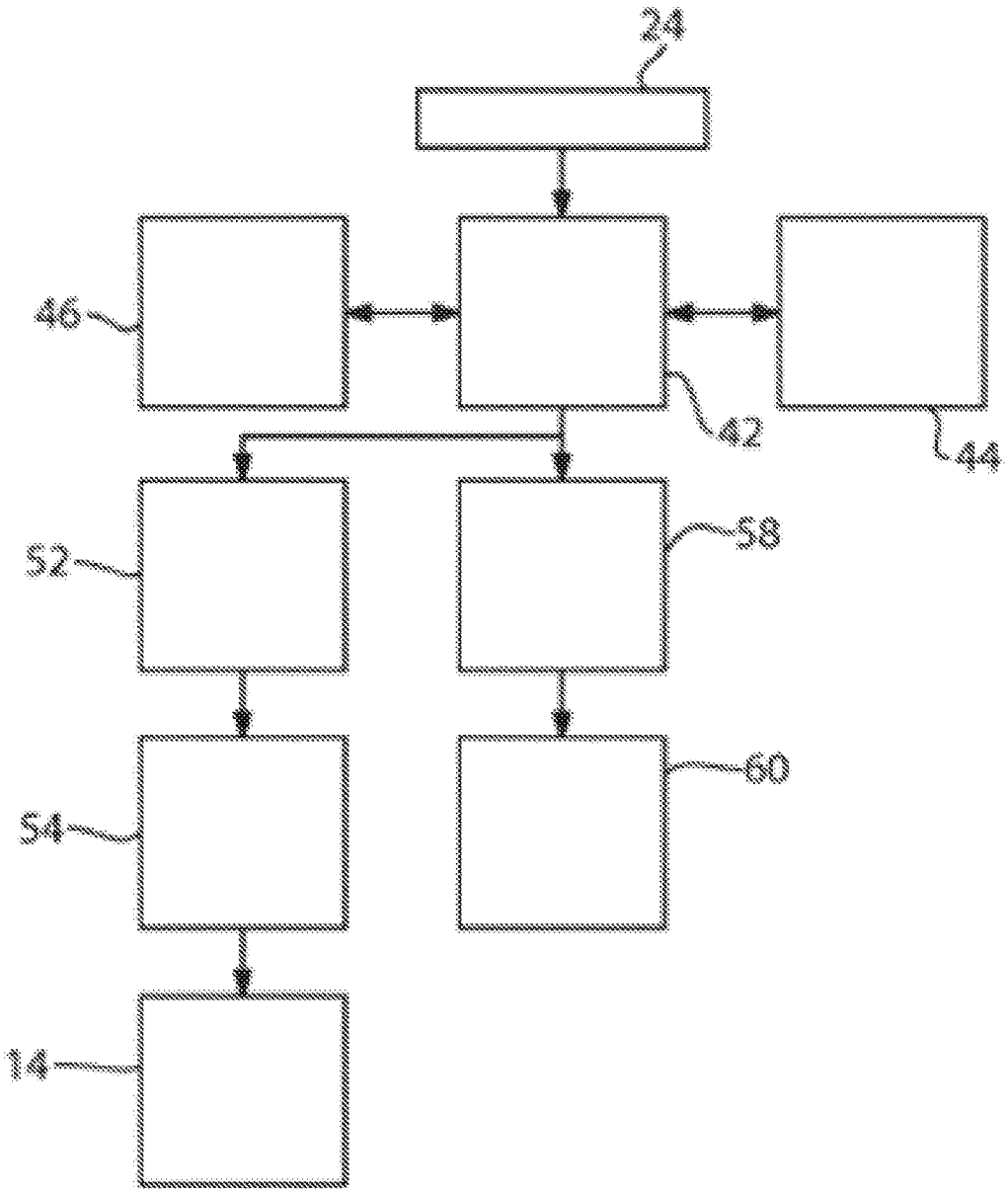
FIG. 3 is a block diagram of various elements of an embodiment of a blackjack video gaming machine.

Reference is now made to FIG. 2 and FIG. 3, which show a variation of a video gaming machine including a display device, a program memory containing a variation of a blackjack video game program, processing circuitry electrically coupled to the program memory, display circuitry connected to the processing circuitry and a display device. and a payout device identifying an amount to be paid to a player for a winning combination of cards. FIG. 2 illustrates one of the many embodiments of a variation of a blackjack video gaming machine 6 which may be used for playing such variation of blackjack. The particular machine shown in FIG. 2 is of the type at which a player may sit and play for extended periods of time. Such variation of blackjack video gaming machine 6 includes a housing 8, a display device 14 such as an LCD screen, a coin and/or bill acceptor 16, a token reader 18 such as a transaction card reader, a payout tray 20, a display 22 identifying the payouts for various hands and other information, and various control inputs 24 such as depressible buttons for inputting player choices. Control inputs 24 may be implemented via one or more touch-sensitive regions of the display device 14, or as separate controls. Various patents, incorporated herein by reference, describe video gaming machines, therefore adequate disclosure of software modification to existing video gaming machines may consist of describing the high level of operation of the machine rather than circuitry details of a conventional design. These patents include U.S. Pat. Nos. 5,542,669; 5,531,441; 5,511,781; 5,100,137; 5,033, 744, and 6,149,521. It is meant that to play a game on such video variation of blackjack on a game machine such as this, a player first inserts coins, bills, a credit card, or other payment form or token into (or proximate to) the gaming machine and places a bet by depressing a predetermined button a desired number of times and such game is thereafter initiated. The various input controls 24, including but not limited to a deal button 26, a hit button 28, a stay button 32, a double down button 36, at least one betting button 38, a payout button and the like, enable such player to interact with such variation of blackjack video gaming machine 6.

According to one embodiment of such variation of blackjack video gaming machine, referring to FIG. 3 a processor 42 receives instructions from a program memory 44 for carrying out the play of the game. Cards are dealt using a random number generator 46. The random number generator may be enabled by instructions in the program memory 44. To display of the cards on the display device 14, a code generated by the processor 42 is converted into a pixel pattern of a card by an image memory 52. Such image memory 52 may be conventional and identifies the illumination levels of the various pixels on screen to create the image displayed to the player. A display driver 54 converts the output of image memory into electrical signals for the screen. The player inputs his or her chosen action relating to his or her hand using the various input controls 24. When the player's final hand is displayed on the display device a payout may be awarded by a payout mechanism 60 if such final hand is a winning hand according to the rules of such variation of a blackjack game. The processor 42 keeps track of the player's hand and the displayed combination is applied to a payout table 58 which cross-references the combination of cards to a player's winnings.

The program memory of such variation of a blackjack video gaming machine may contain instructions for proceeding through the game interactively with the player following at any of the methods described above.

In embodiments that use an electronic gaming system, a sector of the system's display device may include a sequence if icons and/or lights that, when activated, spin as a wheel. A subset of the icons may enable the player to achieve an increased payout ratio if the player has a winning hand, and if the player stops the spinning wheel on one of the icons in the subset. For example, the wheel may include twenty lights, with sixteen of the lights being of a first color and four of the lights being on the second color. If the player stops the spinning wheel at a point when a pointer points to a location on the wheel that contains a light of the second color, then the player may receive an increased payout ratio of the player's next hand is a winning hand.

In some embodiments, the gaming system may use a physical gaming table with a first set of landing areas designated for each player's initial hand and a second, separate set of landing areas designated for any second chance cards that each player may select.

Figure 4:
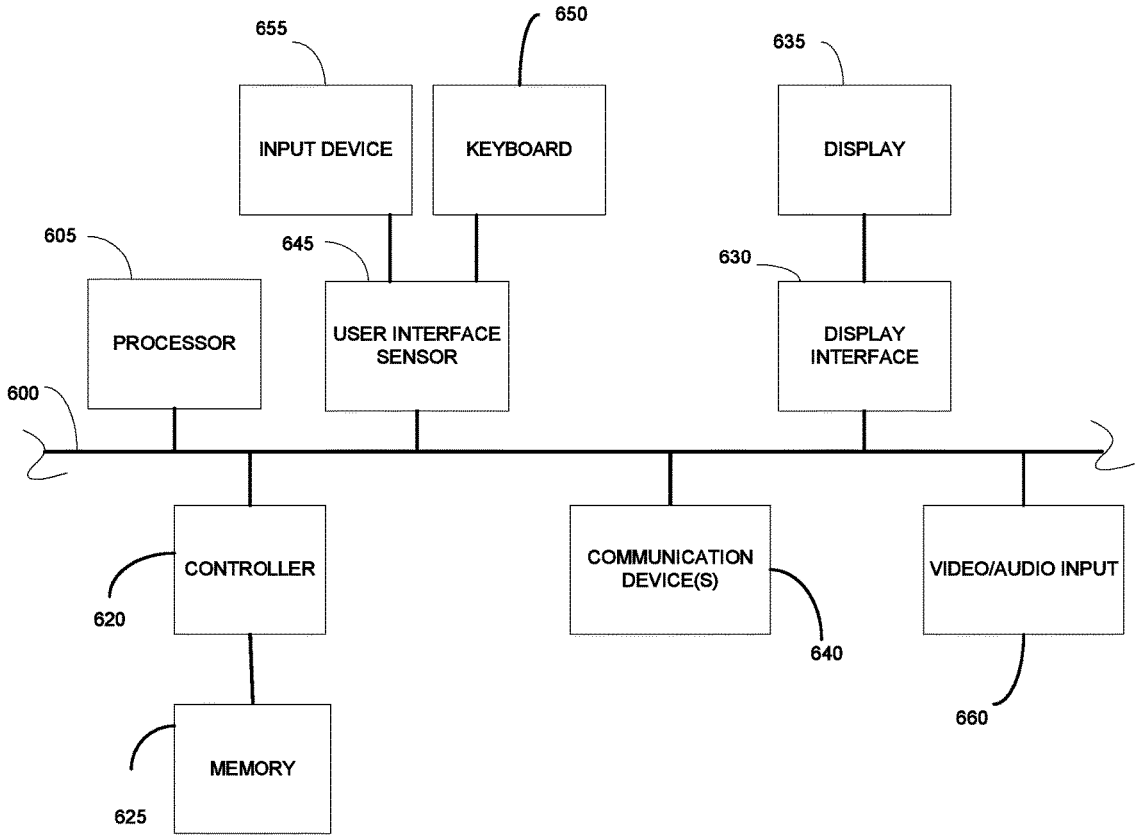
FIG. 4 illustrates various elements of an electronic device that may be programmed to implement any of the features described below.

FIG. 4 depicts a block diagram of hardware that may be used to contain or implement program instructions, such as those of the cloud-based server, parking service provider system, transportation service provider system or mobile electronic device. A bus 600 serves as an information highway interconnecting the other illustrated components of the hardware. Processor (CPU) 605 is a central processing device of the system, performing calculations and logic operations required to execute a program. CPU 605, alone or in conjunction with one or more of the other elements disclosed in FIG. 4, is an example of a processing device, computing device or processor as such terms are used within this disclosure. The processing device may be a physical processing device, a virtual device contained within another processing device, or a container included within a processing device.

A controller 620 interfaces with one or more optional non-transitory computer-readable storage media (i.e., memory device 625) to the bus 600. These storage media may include, for example, an external or internal DVD drive, a CD ROM drive, a hard drive, flash memory, a USB drive, an external server or the like. The memory devices may be integral with the device that contains the processor, or the memory devices may be separate from and communicatively connected to the device that contains the processor.

Program instructions, software or interactive modules for providing the interface and performing any querying or analysis associated with one or more data sets may be stored in any portion of the storage media 625 discussed above.

An optional display interface 630 may permit information from the bus 600 to be displayed on the display 635 in audio, visual, graphic or alphanumeric format. Communication with external devices, such as a printing device, may occur using various communication elements 640, such as a communication port or antenna. A communication element 640 may be communicatively connected to a communication network, such as the Internet or an intranet.

The hardware may also include an interface 645 which allows for receipt of data from input devices such as a keyboard 650 or other input device 655 such as a mouse, a touch pad, a touch screen, a remote control, a pointing device, a video input device and/or an audio input device. Data also may be received from a video or audio capturing device 660 such as a digital camera and/or microphone.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A blackjack playing system comprising:

an electronic gaming system having:

a processor, a display device, a non-transitory memory portion containing a plurality of shoes, each of which represents one or more decks of playing cards shuffled according to a randomization algorithm, and a non-transitory memory portion containing programming instructions that are configured to cause the system to:

receive a first bet from a player via a user interface;

from a first one of the shoes, deal an initial two-card hand to the player;

from the first shoe, deal one or more additional cards to the player;

determine that a sum total value of the initial two-card hand and the one or more additional cards exceeds twenty-one;

receive, from the player, an additional bet;

in response receiving the additional bet, deal a final card to the player from a second one of the shoes;

subtract a value of the final card from the sum total value to yield a new value; and based on the new value, determine whether the player has a winning hand, a push, or a losing hand.

2. The system of claim 1, further comprising instructions to, if the player has a winning hand, determine that the player wins on the first bet and pushes on the additional bet.

3. The system of claim 1, further comprising instructions to, if the player has a losing hand, determine that the player loses on both the first bet and the additional bet.

4. The system of claim 1, further comprising instructions to:

determine whether the new value is 21 or less; and if the new value is 21 or less and exceeds a value of a dealer's hand, provide the player with a payout.

5. The system of claim 1, further comprising instructions to:

determine whether the new value is 21; and if the new value is 21, provide the player with a payout.

6. The system of claim 1:

further comprising instructions to:

in response to determining that the sum total value exceeds 21, offer the player an option to place the additional bet, and deal a dealer's hand from the first shoe; and wherein:

receiving the additional bet is in response to offering the option; and determining whether the player has a winning hand, a push or a losing hand comprises comparing the new value to a value of the dealer's hand and of each additional playing hand in the game and determining whether the player has a winning hand, a push or a losing hand according to conventional blackjack rules regarding point values.

7. The system of claim 1:

further comprising instructions to deal a dealer's hand from the first shoe; and wherein;

the instructions to receive the additional bet comprise instructions to receive a side bet from the player prior to dealing the initial two-card hand to the player, and the instructions to determining whether the player has a winning hand, a push or a losing hand comprises comparing the new value to a value of the dealer's hand and determining whether the player has a winning hand, a push or a losing hand according to conventional blackjack rules regarding point values.

8. The system of claim 1, further comprising instructions to:

determine that the sum of the values of the initial two-card hand and the additional card is 31;

before receiving the additional bet, offer the player an option to place the additional bet and receive a jackpot if the final card has a value of 10; and if the final card has a value of 10 and the new value is 21, provide the player with the jackpot.

* * * * *